US011555295B2

(12) United States Patent
Voelz et al.

(10) Patent No.: US 11,555,295 B2
(45) Date of Patent: Jan. 17, 2023

(54) GROUND ENGAGING TOOL LOCKING SYSTEM

(71) Applicant: Joy Global Surface Mining Inc, Milwaukee, WI (US)

(72) Inventors: Nicholas R. Voelz, West Allis, WI (US); Richard Nicoson, Hartford, WI (US); James Popp, Oak Creek, WI (US); Matt Gross, West Allis, WI (US)

(73) Assignee: Joy Global Surface Mining Inc, Milwaukee, WI (US)

( * ) Notice: Subject to any disclaimer, the term of this patent is extended or adjusted under 35 U.S.C. 154(b) by 144 days.

(21) Appl. No.: 16/792,439

(22) Filed: Feb. 17, 2020

(65) Prior Publication Data

US 2020/0181888 A1 Jun. 11, 2020

Related U.S. Application Data

(63) Continuation of application No. 15/699,453, filed on Sep. 8, 2017, now Pat. No. 10,563,381.

(60) Provisional application No. 62/479,056, filed on Mar. 30, 2017, provisional application No. 62/385,719, filed on Sep. 9, 2016.

(51) Int. Cl.

| | |
|---|---|
| ***E02F 9/28*** | (2006.01) |
| *E02F 3/30* | (2006.01) |
| *E21C 27/30* | (2006.01) |

(52) U.S. Cl.

CPC ..... *E02F 9/2841* (2013.01); *E02F 9/2825* (2013.01); *E02F 3/308* (2013.01); *E02F 9/2833* (2013.01); *E21C 27/30* (2013.01)

(58) Field of Classification Search

CPC ..... E02F 9/2825; E02F 9/2833; E02F 9/2841

See application file for complete search history.

(56) References Cited

U.S. PATENT DOCUMENTS

| | | | | |
|---|---|---|---|---|
| 3,952,433 A * | 4/1976 | Heinold | ..... | E02F 9/2841 24/581.1 |
| 4,716,668 A | 1/1988 | Hahn | | |
| 4,727,663 A * | 3/1988 | Hahn | ..... | E02F 9/2841 37/458 |
| 4,848,013 A | 7/1989 | Bowman et al. | | |
| 4,918,843 A * | 4/1990 | Kiesewetter | ..... | E02F 9/2841 267/141 |

(Continued)

FOREIGN PATENT DOCUMENTS

| | | |
|---|---|---|
| CN | 103168138 A | 6/2013 |
| CN | 103452163 A | 12/2013 |

(Continued)

OTHER PUBLICATIONS

Chinese Patent Office Action for Application No. 201710801122.4 dated Jul. 7, 2021 (6 pages including brief English summary).

(Continued)

*Primary Examiner* — Gary S Hartmann

(74) *Attorney, Agent, or Firm* — Michael Best & Friedrich LLP

(57) ABSTRACT

A ground engaging tool locking system includes a pin having a first, proximal head region and a second, distal end region spaced from the first, proximal head region along an axis. The pin includes a groove located between the first, proximal head region and the second, distal end region. A biasing element is disposed at least partially within the groove.

14 Claims, 12 Drawing Sheets

(56) References Cited

U.S. PATENT DOCUMENTS

| | | | | |
|---|---|---|---|---|
| 5,172,500 | A | 12/1992 | Renski et al. | |
| 5,205,057 | A | 4/1993 | Garman | |
| 5,412,885 | A | 5/1995 | Cornelius | |
| 5,709,043 | A | 1/1998 | Jones et al. | |
| 5,729,052 | A | 3/1998 | Tonti et al. | |
| 5,765,301 | A | 6/1998 | Clendenning | |
| 5,855,052 | A | 1/1999 | Becker et al. | |
| 5,913,605 | A | 6/1999 | Jusselin et al. | |
| 6,092,958 | A | 7/2000 | Gale | |
| 6,108,950 | A | 8/2000 | Ruvang et al. | |
| 6,735,890 | B2 | 5/2004 | Carpenter et al. | |
| 6,735,891 | B2 | 5/2004 | Pallas Moreno et al. | |
| 6,757,995 | B2 | 7/2004 | Pippins | |
| 6,993,861 | B2 | 2/2006 | Carpenter et al. | |
| 7,032,334 | B2 | 4/2006 | Pippins | |
| 7,178,274 | B2 | 2/2007 | Emrich | |
| 7,367,144 | B2 | 5/2008 | Jones et al. | |
| 7,603,799 | B2 * | 10/2009 | Campomanes | E02F 9/2841 37/459 |
| 7,640,685 | B2 | 1/2010 | Emrich | |
| 7,788,830 | B2 | 9/2010 | Woerman et al. | |
| 8,104,200 | B2 * | 1/2012 | Briscoe | E02F 9/2841 37/456 |
| 8,127,476 | B2 * | 3/2012 | Bierwith | E02F 9/2833 172/772 |
| 8,327,563 | B2 | 12/2012 | Dingwall et al. | |
| 8,434,248 | B2 * | 5/2013 | Woerman | E02F 9/2833 37/456 |
| 8,555,532 | B2 | 10/2013 | Lopez Almendros et al. | |
| 8,578,637 | B2 | 11/2013 | Ollinger, IV et al. | |
| 8,689,472 | B2 | 4/2014 | Carpenter et al. | |
| 8,959,807 | B2 | 2/2015 | LaHood et al. | |
| 9,176,184 | B2 | 11/2015 | Knox et al. | |
| 9,476,184 | B2 * | 10/2016 | Wallis | E02F 9/2833 |
| 9,493,930 | B2 | 11/2016 | Carpenter et al. | |
| 10,106,961 | B2 * | 10/2018 | Rol Corredor | E02F 9/2858 |
| 10,364,553 | B2 * | 7/2019 | Snyder | E02F 9/2833 |
| 10,563,381 | B2 | 2/2020 | Voelz et al. | |
| 11,035,103 | B2 * | 6/2021 | Bjerke | E02F 9/2833 |
| 2008/0092413 | A1 | 4/2008 | McClanahan et al. | |
| 2012/0051836 | A1 | 3/2012 | Jakubisin | |
| 2012/0304508 | A1 | 12/2012 | Guimaraes et al. | |
| 2014/0223784 | A1 * | 8/2014 | Endersby | E02F 9/2841 37/456 |

FOREIGN PATENT DOCUMENTS

| | | | |
|---|---|---|---|
| CN | 103781973 | A | 5/2014 |
| SU | 621843 | A1 | 8/1978 |
| SU | 706588 | A1 | 12/1979 |

OTHER PUBLICATIONS

Mexican Patent Office 1st Substantive Examination Requirement for Application No. MX/a/2017/011567 dated Oct. 29, 2020 (7 pages including English translation).

Intellectual Property of India Examination Report for Application No. 201714031776 dated Mar. 30, 2021 (5 pages including English translation).

Chilean Patent Office Action for Application No. 202001170 dated Oct. 12, 2021 (28 pages including Statement of Relevance).

Chinese Patent Office Action and Search Report for Application No. 201710801122.4 dated Jan. 11, 2021 (11 pages including English summary).

Russian Patent Office Action and Search Report for Application No. 2017131518 dated Jan. 21, 2021 (16 pages including English translation).

* cited by examiner

GROUND ENGAGING TOOL LOCKING SYSTEM

CROSS-REFERENCE TO RELATED APPLICATIONS

This application is a continuation of U.S. application Ser. No. 15/699,453, filed Sep. 8, 2017, and claims priority to U.S. Provisional Application No. 62/479,056, filed Mar. 30, 2017, and to U.S. Provisional Application No. 62/385,719, filed Sep. 9, 2016, the entire contents of each of which are incorporated herein by reference.

FIELD OF THE INVENTION

The present invention relates to ground engaging tools, and more specifically to a locking system for locking together two ground engaging tools on a mining machine.

Ground engaging tools (GET's) are commonly used on the dipper of a mining machine to absorb wear and damage as the mining machine digs through materials in a mine. Such GET's typically include one or more adapters that fit over the lip of a dipper, and/or one or more teeth that fit over the adapters or fit directly onto the lip. The adapters and teeth are removed and replaced as needed during the lifetime of the mining machine. Various systems have been developed to removably lock the teeth to the adapters, and/or to removably lock the adapters to the lip. However, many such systems include excessive numbers of components, are bulky, expensive, require excess amounts of time and effort to install and remove, and are otherwise undesirable.

SUMMARY

In accordance with one construction, a locking system includes a pin having a first, proximal head region and a second, distal end region spaced from the first, proximal head region along an axis. The pin includes a groove located between the first, proximal head region and the second, distal end region. A biasing element is disposed at least partially within the groove.

In accordance with another construction, a locking system includes a pin having a first, proximal head region and a second, distal end region spaced from the first, proximal head region along an axis. The pin includes a groove located between the first, proximal head region and the second, distal end region. The groove is configured to receive a biasing element. The pin includes helical ramped surfaces along a distal end of the first, proximal head region.

In accordance with another construction, a locking system includes an adapter configured to be coupled to a lip of a dipper on a mining machine. The adapter has an interior passage to receive a pin. The interior passage includes a first diameter where a distal end region of the pin is configured to initially enter the adapter, and a second diameter that is disposed further within the adapter. The second diameter is smaller than the first diameter. The adapter includes helical ramped surfaces configured to contact corresponding helical ramped surfaces on the pin.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited.

DETAILED DESCRIPTION

Figure 1:
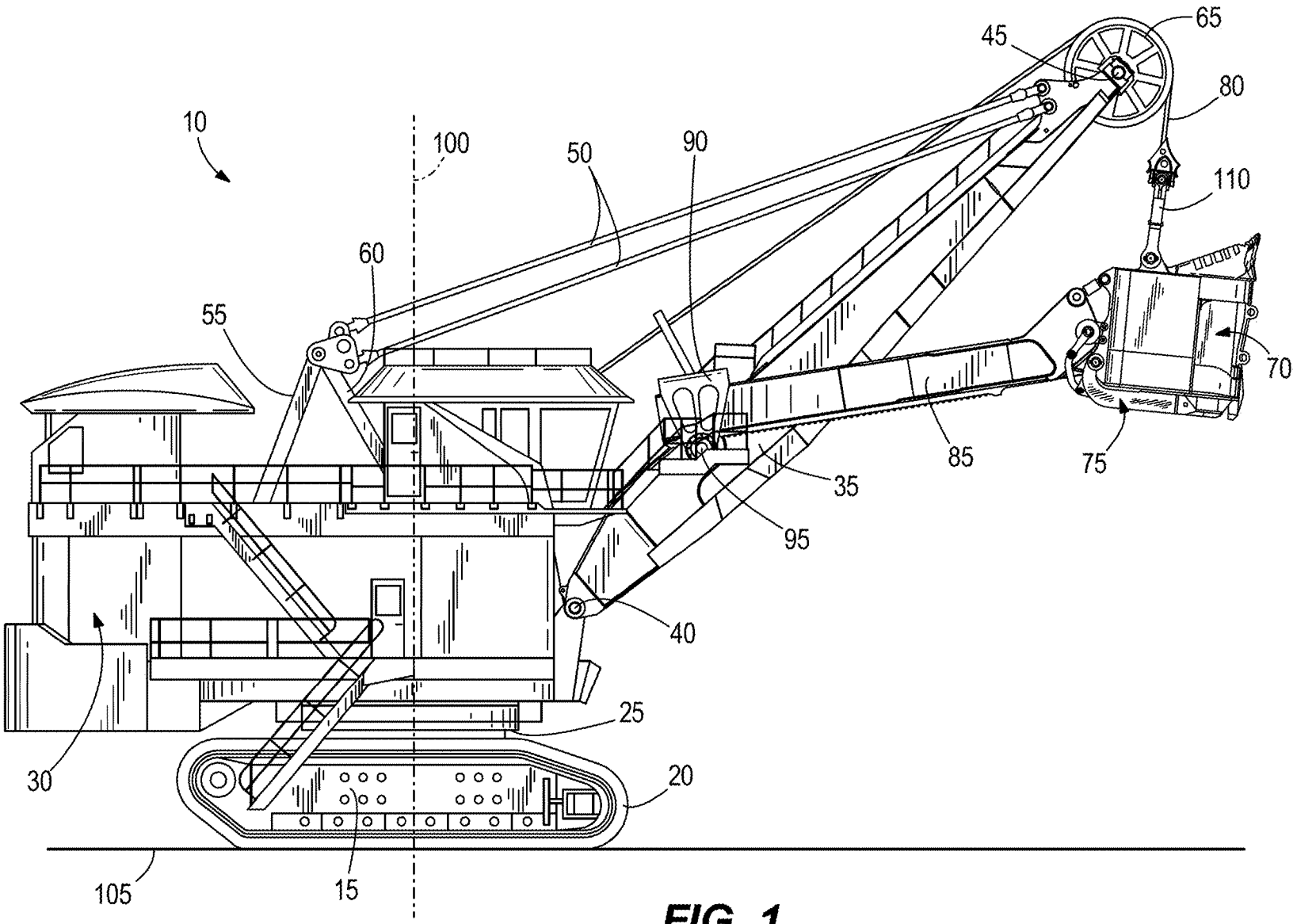
FIG. 1 is a side view of a mining shovel.

FIG. 1 illustrates a power shovel 10. The shovel 10 includes a mobile base 15, drive tracks 20, a turntable 25, a revolving frame 30, a boom 35, a lower end 40 of the boom 35 (also called a boom foot), an upper end 45 of the boom 35 (also called a boom point), tension cables 50, a gantry tension member 55, a gantry compression member 60, a sheave 65 rotatably mounted on the upper end 45 of the boom 35, a dipper 70, a dipper door 75 pivotally coupled to the dipper 70, a hoist rope 80, a winch drum (not shown), a dipper handle 85, a saddle block 90, a shipper shaft 95, and a transmission unit (also called a crowd drive, not shown). The turntable 25 allows rotation of the upper frame 30 relative to the lower base 15. The turntable 25 defines a rotational axis 100 of the shovel 10. The rotational axis 100 is perpendicular to a plane 105 defined by the base 15 and generally corresponds to a grade of the ground or support surface.

The mobile base 15 is supported by the drive tracks 20. The mobile base 15 supports the turntable 25 and the revolving frame 30. The turntable 25 is capable of 360-degrees of rotation relative to the mobile base 15. The boom 35 is pivotally connected at the lower end 40 to the revolving frame 30. The boom 35 is held in an upwardly and outwardly extending relation to the revolving frame 30 by the tension cables 50, which are anchored to the gantry tension member 55 and the gantry compression member 60. The gantry compression member 60 is mounted on the revolving frame 30.

The dipper 70 is suspended from the boom 35 by the hoist rope 80. The hoist rope 80 is wrapped over the sheave 65 and attached to the dipper 70 at a bail 110. The hoist rope 80 is anchored to the winch drum (not shown) of the revolving frame 30. The winch drum is driven by at least one electric motor (not shown) that incorporates a transmission unit (not shown). As the winch drum rotates, the hoist rope 80 is paid out to lower the dipper 70 or pulled in to raise the dipper 70. The dipper handle 85 is also coupled to the dipper 70. The dipper handle 85 is slidably supported in the saddle block 90, and the saddle block 90 is pivotally mounted to the boom 35 at the shipper shaft 95. The dipper handle 85 includes a rack and tooth formation thereon that engages a drive pinion (not shown) mounted in the saddle block 90. The drive pinion is driven by an electric motor and transmission unit (not shown) to extend or retract the dipper handle 85 relative to the saddle block 90.

An electrical power source (not shown) is mounted to the revolving frame 30 to provide power to a hoist electric motor (not shown) for driving the hoist drum, one or more crowd electric motors (not shown) for driving the crowd transmission unit, and one or more swing electric motors (not shown) for turning the turntable 25. Each of the crowd, hoist, and swing motors is driven by its own motor controller, or is alternatively driven in response to control signals from a controller (not shown).

Figure 2:
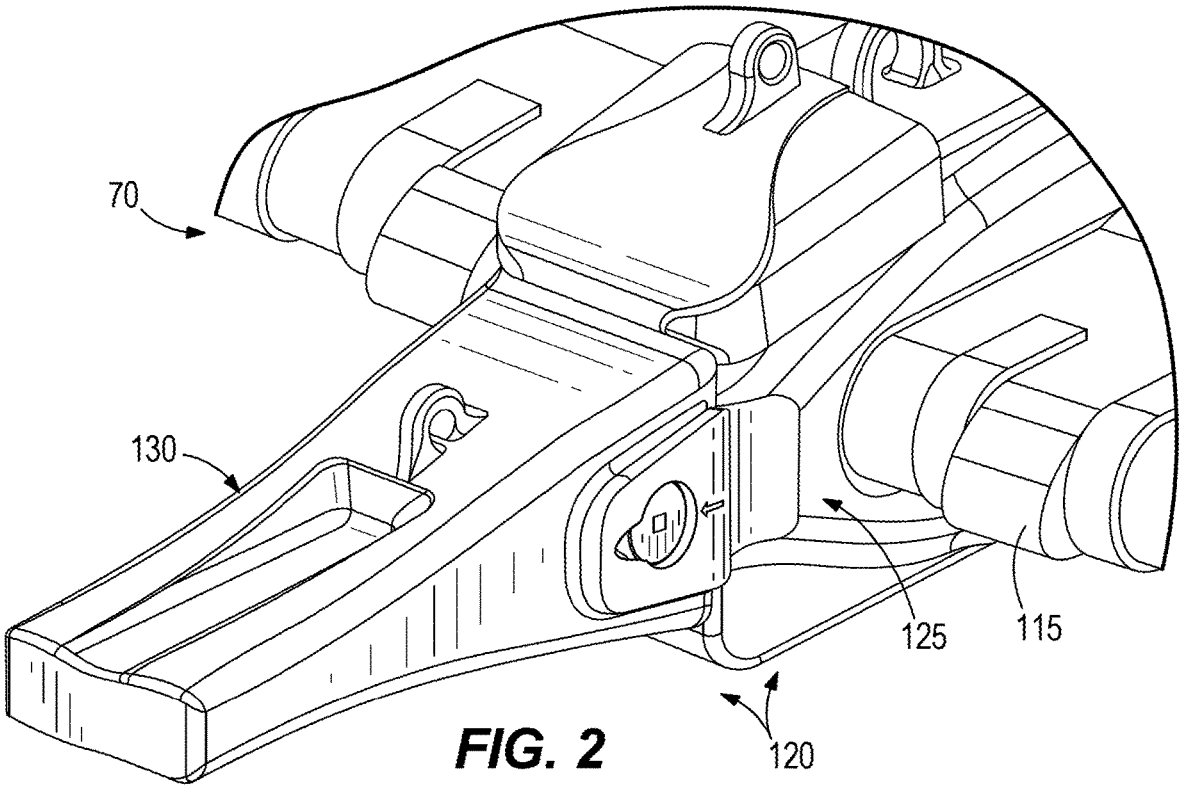
FIG. 2 is a perspective view of a portion of a dipper of the mining shovel, illustrating an adapter and a tooth.

Referring to FIG. 2, the dipper 70 includes a lip 115 and at least one GET 120 coupled to the lip 115. In the illustrated construction, the at least one GET 120 includes an adapter 125 coupled directly to the lip 115, and a tooth point 130 coupled directly to the adapter 125. While only a single adapter 125 and tooth point 130 are illustrated, in some constructions the dipper 70 includes plurality of adapters 125 and tooth points 130 disposed adjacent one another along the dipper lip 115 (e.g., in varying patterns).

Figure 3:
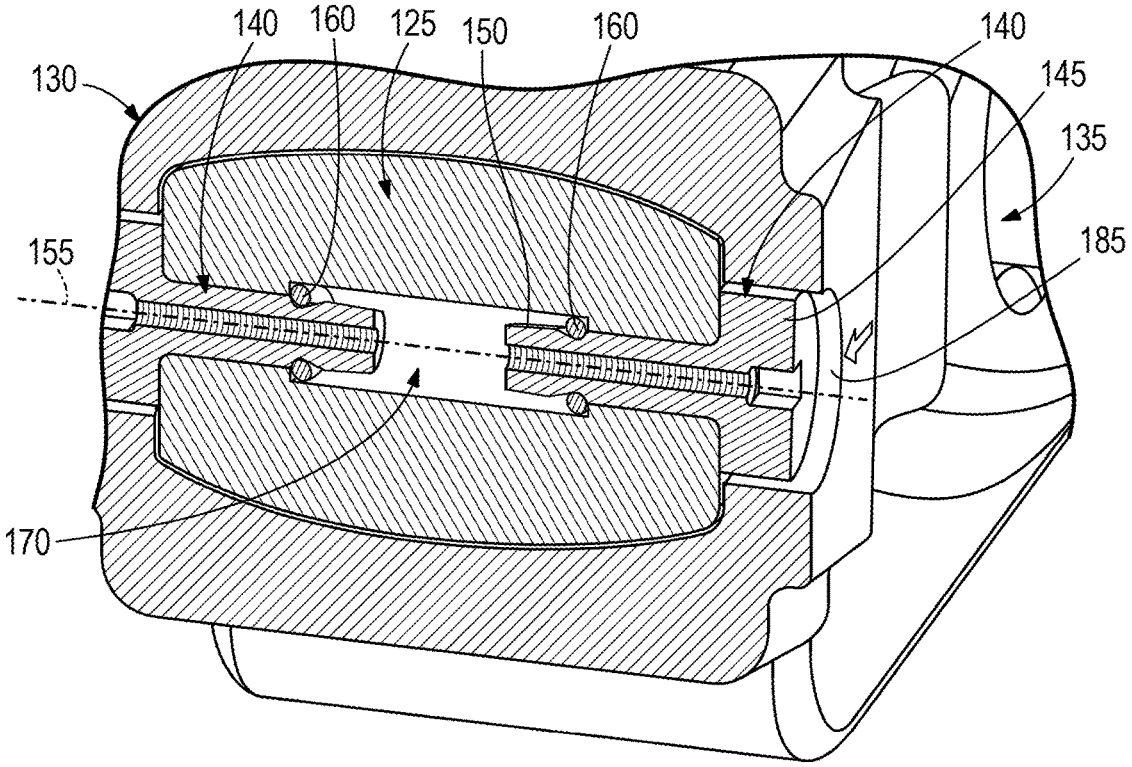
FIG. 3 is a perspective view of a locking system according to one construction that releasably couples the adapter to the tooth, the locking system including pins.
Figure 4:
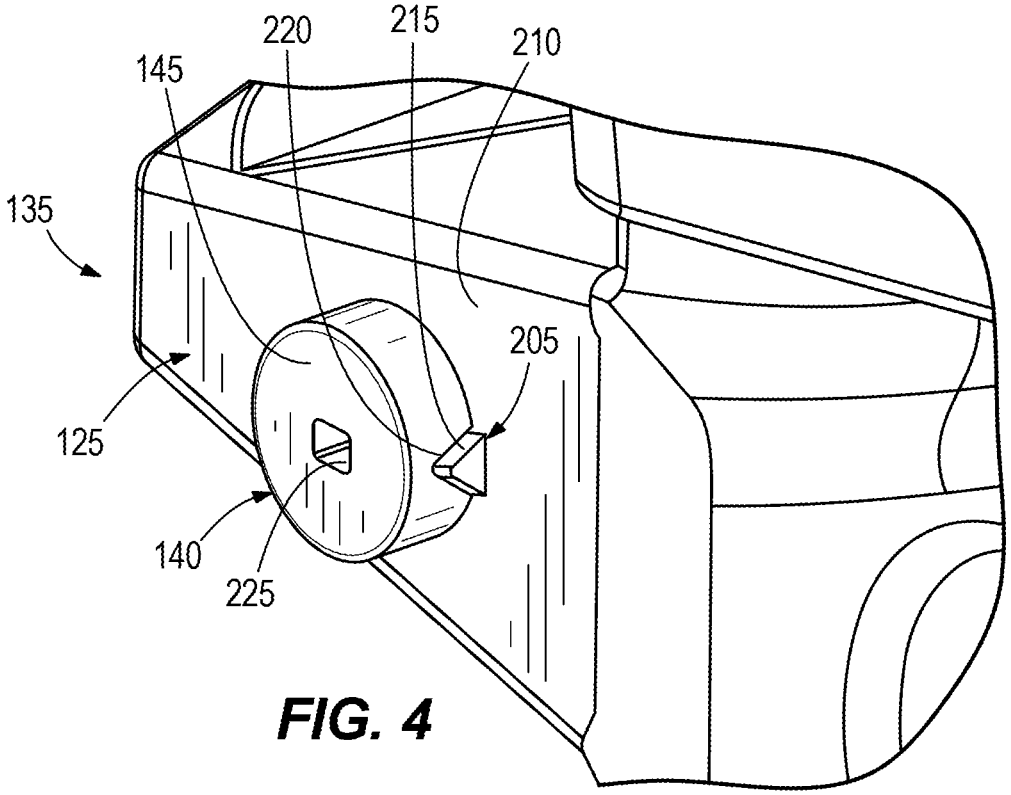
FIGS. 4 and 5 are perspective views of the locking system, illustrating removal of one of the pins.
Figure 5:
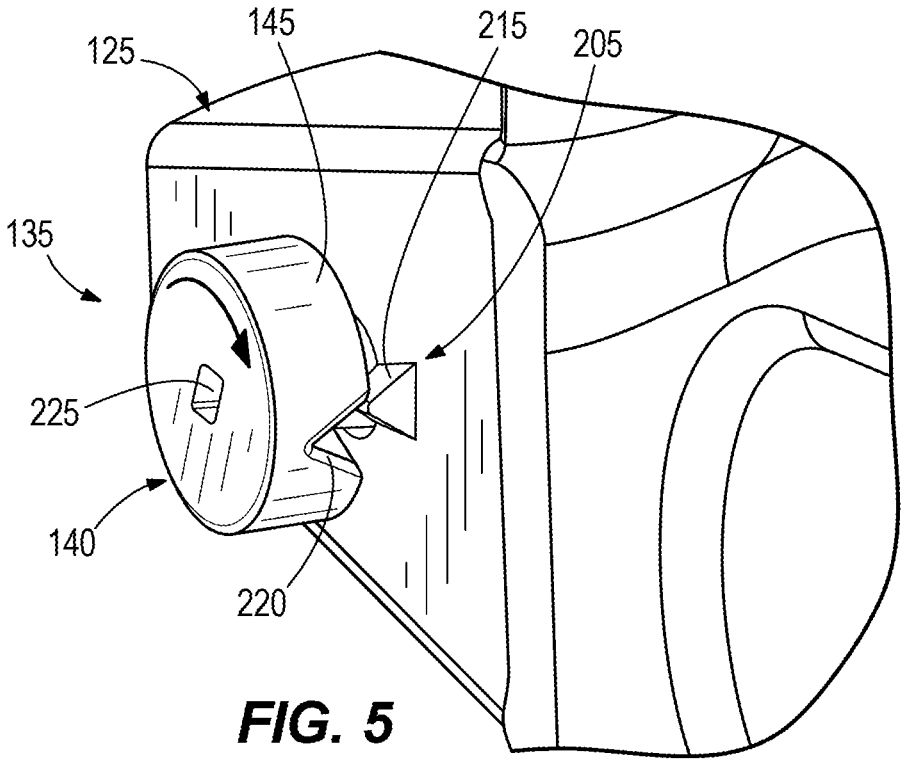

Referring to FIGS. 3-8, the power shovel 10 also includes a tooth point locking system 135 that releasably couples the tooth point 130 to the adapter 125. The tooth point locking system 135 includes at least one pin 140. In the illustrated construction, the tooth point locking system 135 includes two pins 140. Each of the pins 140 includes a first, proximal head region 145 and a second, distal end region 150 that is spaced from the first, proximal head region 145 along an axis 155 (FIG. 3). The first, proximal head region 145 is radially larger than the second, distal end region 150. In the illustrated construction, the second, distal end region 150 tapers in diameter along the axis 155 moving away from the first, proximal head region 145, although other constructions include a second, distal end region 150 having a constant diameter or otherwise having a different shape than that illustrated.

Figure 6:
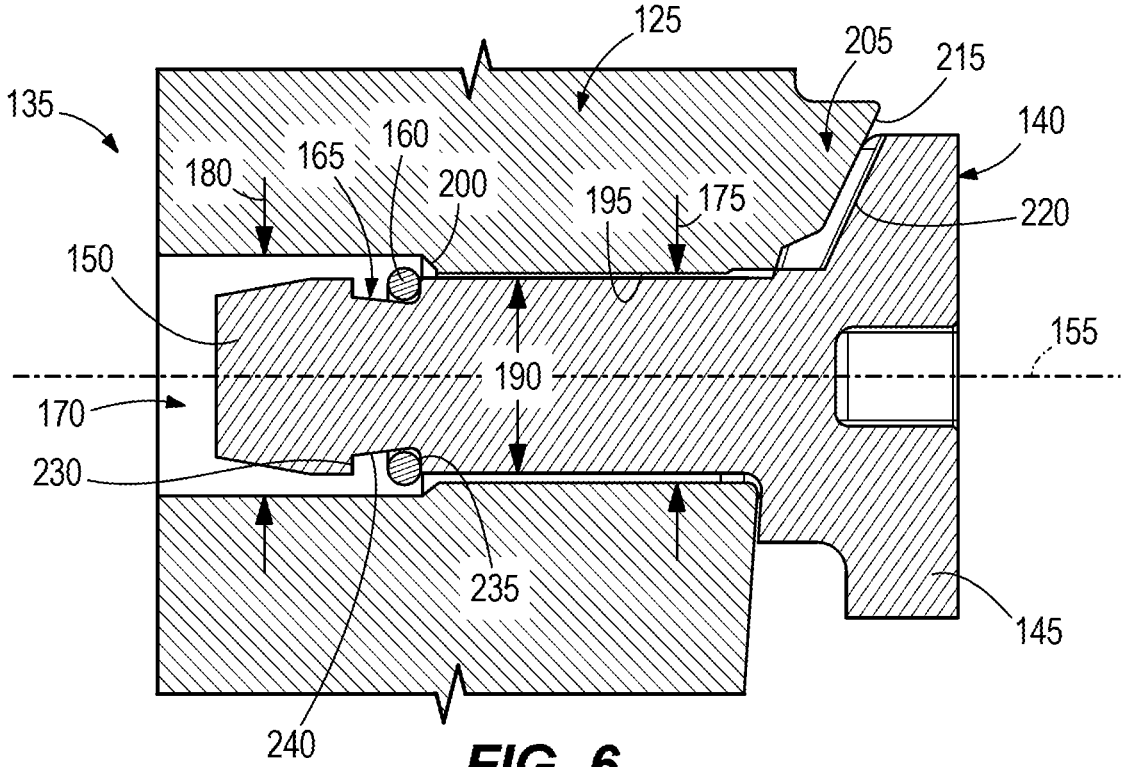
FIGS. 6 and 7 are cross-sectional views of the locking system, illustrating removal of one of the pins.
Figure 7:
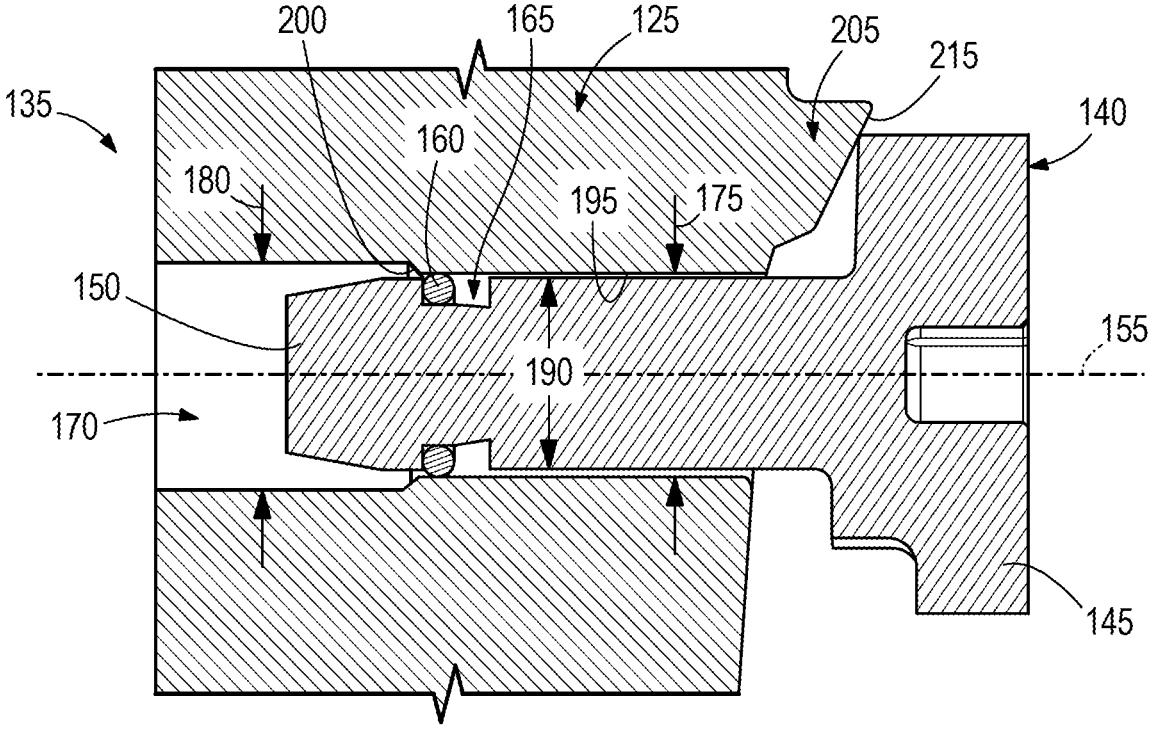

Referring to FIGS. 3, 6, and 7, the tooth point locking system 135 further includes biasing elements 160 (illustrated schematically) that are coupled to the pins 140. As illustrated in FIGS. 6 and 7, each of the pins 140 includes a groove 165 (e.g., a circumferential groove) located between the first, proximal head region 145 and the second, distal end region 150. The biasing elements 160 are shaped and sized to fit in the grooves 165, and positioned such that when the biasing elements 160 are in a natural, uncompressed state (FIG. 6), portions of the biasing elements 160 are disposed within the grooves 165 and other portions of the biasing elements 160 extend radially outwardly away from the grooves 165. In the illustrated construction, the biasing elements 160 are coil springs wound circumferentially around the pins 140. However, other constructions include different types of biasing elements 160. For example, in some constructions, the biasing elements 160 are O-rings, or other structures that exhibit a spring force and are compressible radially inwardly.

Referring to FIGS. 3, 6, and 7, the tooth point locking system 135 further includes at least one interior passage 170 in the adapter 125 to receive the pins 140 and the biasing elements 160. In the illustrated construction, the tooth point locking system 135 includes a single interior passage 170 that extends entirely through the adapter 125. As illustrated in FIGS. 6 and 7, the interior passage 170 includes a first diameter 175 where the second, distal end region 150 of the pin 140 initially enters the adapter 125, and a second diameter 180 that is disposed further within the adapter 125. The second diameter 180 is larger than the first diameter 175. The tooth point locking system 135 additionally includes recesses 185 (FIG. 3) in the tooth points 130 that are shaped and sized to receive the first, proximal head regions 145 of the pins 140.

Referring to FIGS. 3-8, each of the pins 140 is inserted into the adapter 125 simply by pressing and/or pushing on the pins 140 axially, along the axis 155 (each of the pins 140 being inserted along an opposite direction along the axis 155). As illustrated in FIGS. 6 and 7, the pins 140 each have an outer diameter 190 between the first, proximal head region 145 and the second, distal end region 150 that is equal to or smaller than the first diameter 175, such that the pin 140 may slide axially into the adapter 125. When the pin 140 slides into the adapter 125, the biasing element 160 is radially compressed into the groove 165 by an interior wall 195 of the adapter 125 that forms the interior passage 170. The biasing element 160 compresses at least to a diameter equal to or less than the first diameter 175, thereby allowing the pin 140 and the biasing element 160 to slide together within the interior passage 170 until the biasing element 160 reaches the second diameter 180.

When the biasing element 160 reaches the second diameter 180, the biasing element 160 expands radially outwardly within the adapter 125 and acts as a stop to inhibit axial movement of the pin 140 back out of the adapter 125. If the pin 140 is pulled back axially, the biasing element 160 presses against an interior wall 200 that forms a transition between the first diameter 175 and the second diameter 180 within the adapter 125. The pin 140 is thereby temporarily locked into the adapter 125. As illustrated in FIG. 3, in this locked position the first, proximal head region 145 is nested within the recess 185 on the tooth point 130.

Referring to FIGS. 4-7, the adapter 125 further includes protrusion 205 extending from outer surfaces 210 that facilitate both insertion and removal of the pins 140. In the illustrated construction, the protrusions 205 are wedges, each having an inclined surface 215. The first, proximal head region 145 of the pin 140 has a corresponding notch 220 that is sized and shaped to fit over the protrusion 205 when the pins 140 are pushed into the adapter 125.

To remove the pins 140 from the adapter 125, the pins 140 are initially rotated about the axis 155. For example, in the illustrated construction the pins 140 each include a tool engagement recess 225 along the first, proximal head regions 145. While the illustrated tool engagement recess 225 has a generally square shape, other constructions include different shapes. In some constructions, a tool engagement projection is instead used to receive a tool. In the illustrated construction, a tool (e.g., wrench or other hand tool) is inserted into the tool engagement recess 225, and is turned to cause the pin 140 to rotate about the axis 155. As illustrated in FIGS. 6 and 7, rotation of the pin 140 about the axis 155 causes the first, proximal head region 145 (in the area of the notch 220) to ride up along the protrusion 205, thereby causing an axial displacement of the pin 144 along the axis 155 (FIG. 7).

Referring to FIGS. 6 and 7, the axial displacement of the pin 140 along the axis 155 forces the biasing element 160 to move from the area of the interior passage 170, having the larger second diameter 180, to the area of the interior passage 170, having the smaller, first diameter 175. This movement compresses the biasing element 160 back into the groove 165, allowing the pin 140 and the biasing element 160 to slide along the interior passage 170 and out of the adapter 125.

Referring to FIGS. 6 and 7, in some constructions the groove 165 has a larger width than the biasing element 160, such that the biasing element 160 may slide and move within the groove 165 as the pin 140 moves between a locked position (i.e., where the biasing element 160 has expanded within the larger second diameter 180 as shown in FIG. 6) and an unlocked position (i.e., where the biasing element 160 has been compressed as shown in FIG. 7). As illustrated in FIG. 6, in some constructions the groove 165 may be formed by a first wall 230, a second wall 235, and a third wall 240. The first and second walls 230, 235 are parallel to one another, and the third wall 240 is inclined at an oblique angle relative to both the first and second walls 230, 235. Other constructions include different shapes and sizes for the grooves 165 than that illustrated.

Figure 8:
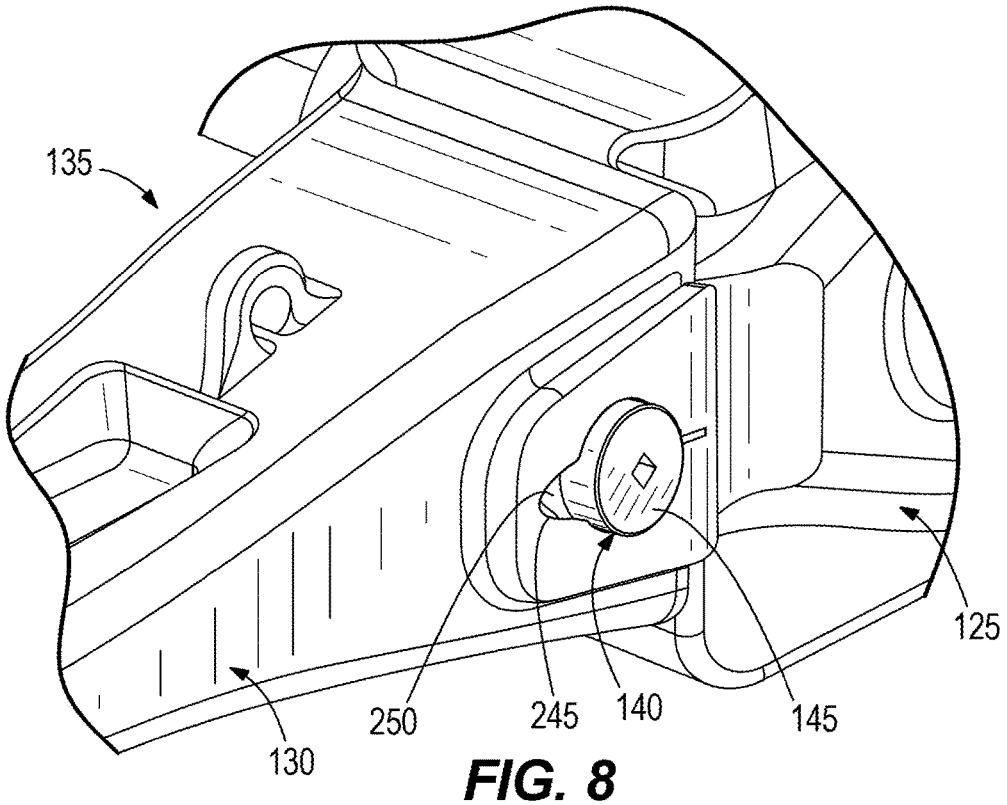
FIG. 8 is a perspective view of the locking system, illustrating a prying recess on a tooth point, and a prying notch on one of the pins.

Referring to FIG. 8, in the illustrated construction the tooth points 130 also each include a prying recess 245. In some constructions, the prying recess forms part of the recess 185 that is shaped and sized to receive the first, proximal head regions 145. As illustrated in FIG. 8, the first, proximal head regions 145 each also include a prying notch 250 that is accessible and visible through prying recess 245 once the pin 140 has been rotated and has been axially displaced by riding up the protrusion 205. In some constructions, the prying notch 250 is otherwise generally hidden and is not accessible.

Once the pins 140 have been rotated and axially displaced, a pry bar or other structure may be inserted through each prying recess 245 and into or under each prying notch 250, to grasp hold of the pins 140 and pull the pins 140 fully out of the adapter 125. Other constructions do not include a pry recess 245 and/or pry notch 250. For example, in some construction, once the pins 140 have been initially rotated and axially displaced (and the biasing elements 160 have been compressed), the pins 140 may be pulled out by hand, or with a different tool (e.g., eyelet) that grasps portions of the pins 140 and is used to pull the pins 140 fully out of the adapter 125.

Figure 9:
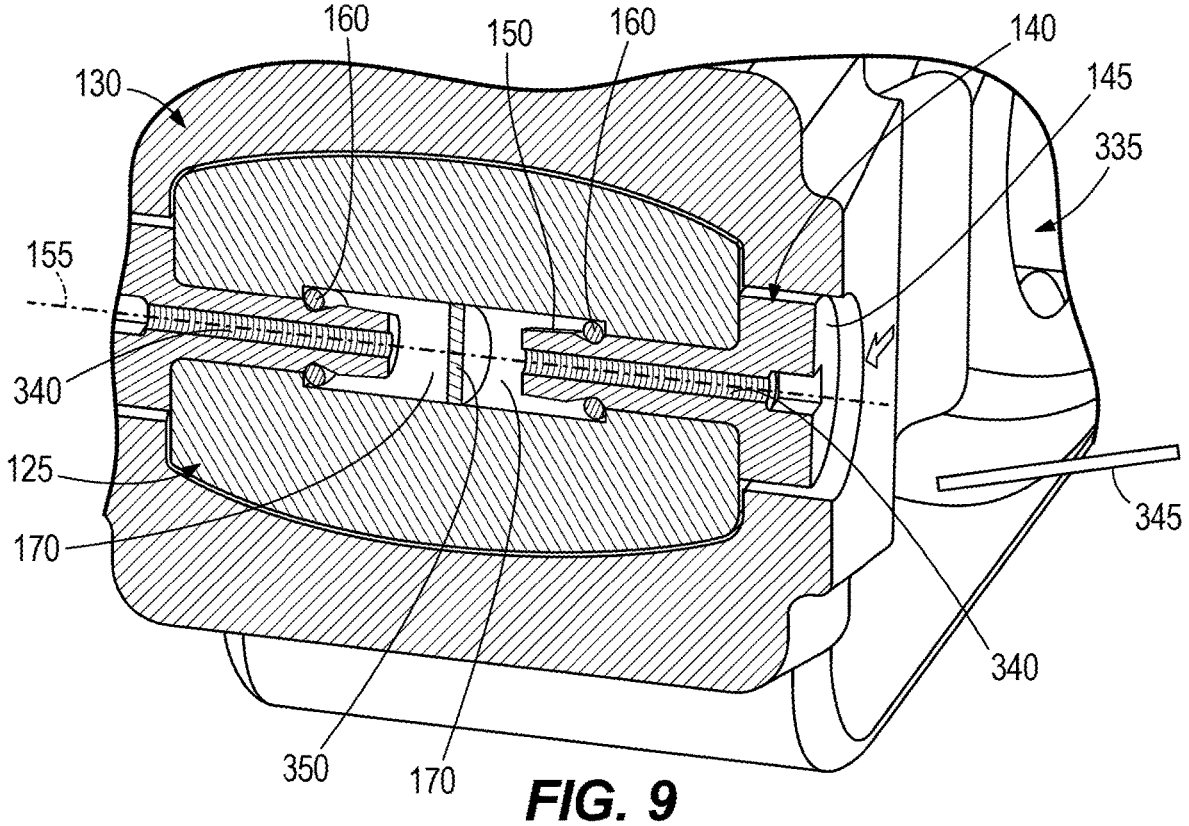
FIG. 9 is a perspective view of a locking system according to another construction.

FIG. 9 illustrates a tooth point locking system 335 that releasably couples the tooth point 130 to the adapter 125. The tooth point locking system 335 includes the same pins 140 and biasing elements 160 as those described above, although other constructions may include different pins and/or biasing elements. As illustrated in FIG. 9, the pins 140 each include an internal aperture 340 that receives a tool to facilitate removal of the pins 140. In the illustrated construction, the internal aperture 340 of each pin 140 is threaded, and receives a threaded tool 345 (e.g., a jacking bolt, etc., illustrated schematically in FIG. 9). The threaded tool 345 is inserted axially through the internal aperture 340 of each pin 140 along the axis 155. The tooth point locking system 335 additionally includes an internal wall 350 (illustrated schematically) within the adapter 125. The internal wall 350 separates the interior passage 170 (e.g., creating two blind bores instead of a single through-passage as in the embodiment of FIGS. 1-8). When the threaded tool 345 is inserted through the internal aperture 340 in the pin 140, the threaded tool 345 eventually contacts the internal wall 350 and presses against the internal wall 350. As the threaded tool 345 continues to rotate, the pin 140 is forced in an opposite direction axially along the axis 155 away from the internal wall 350, thereby compressing the biasing element 160 back toward the groove 165, and allowing the pin 140 and the biasing element 160 to slide along the interior passage 170 and out of the adapter 125. In the illustrated construction, the protrusion 205, the notch 220, the prying recess 245, and the prying notch 250 are not included in the tooth point locking system 335. Rather, the pins 140 are removed solely by use of the internal apertures 340, the threaded tool 345, and the internal wall 350.

Figure 10:
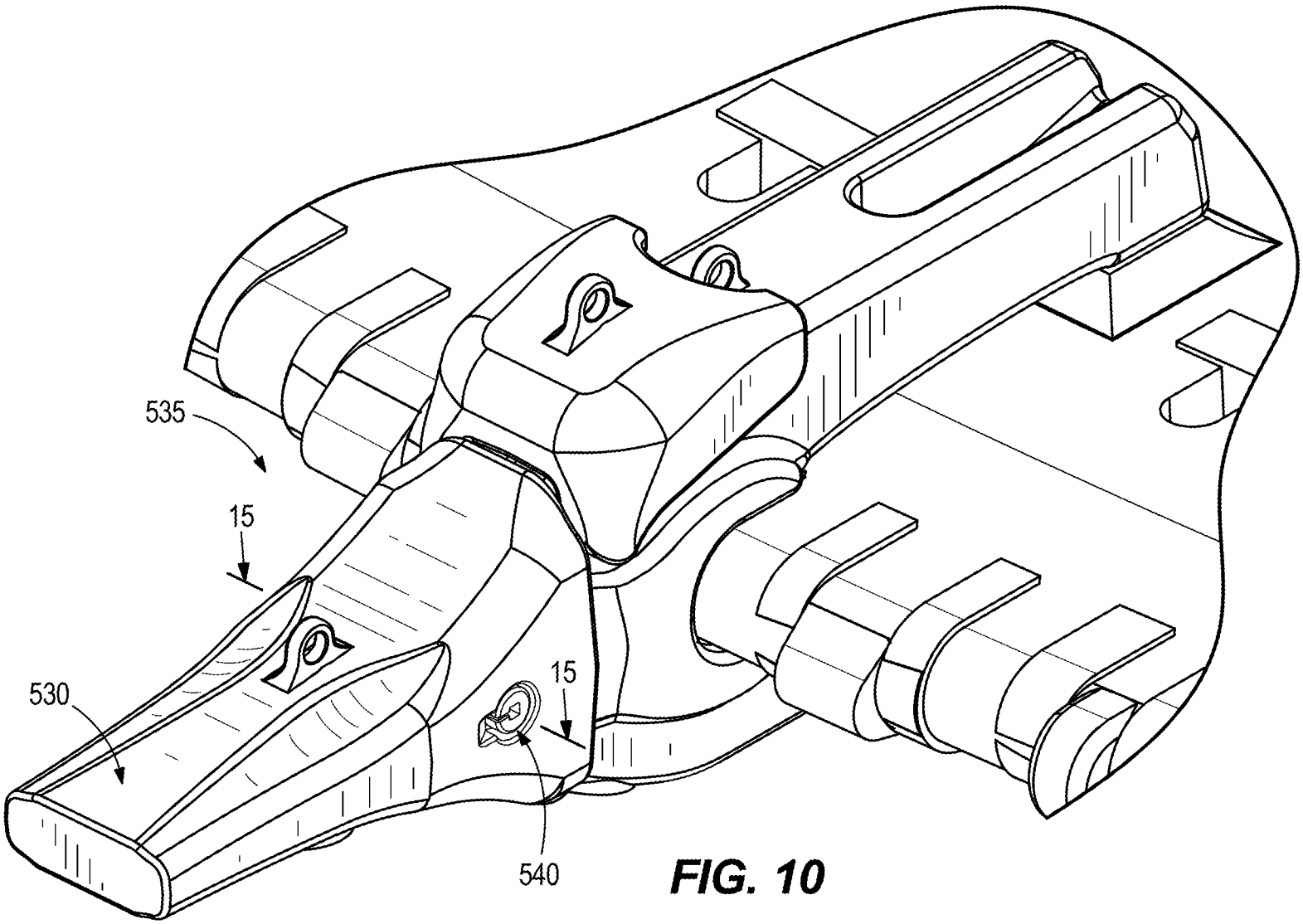
FIG. 10 is a perspective view of a locking system according to another construction.
Figure 11:
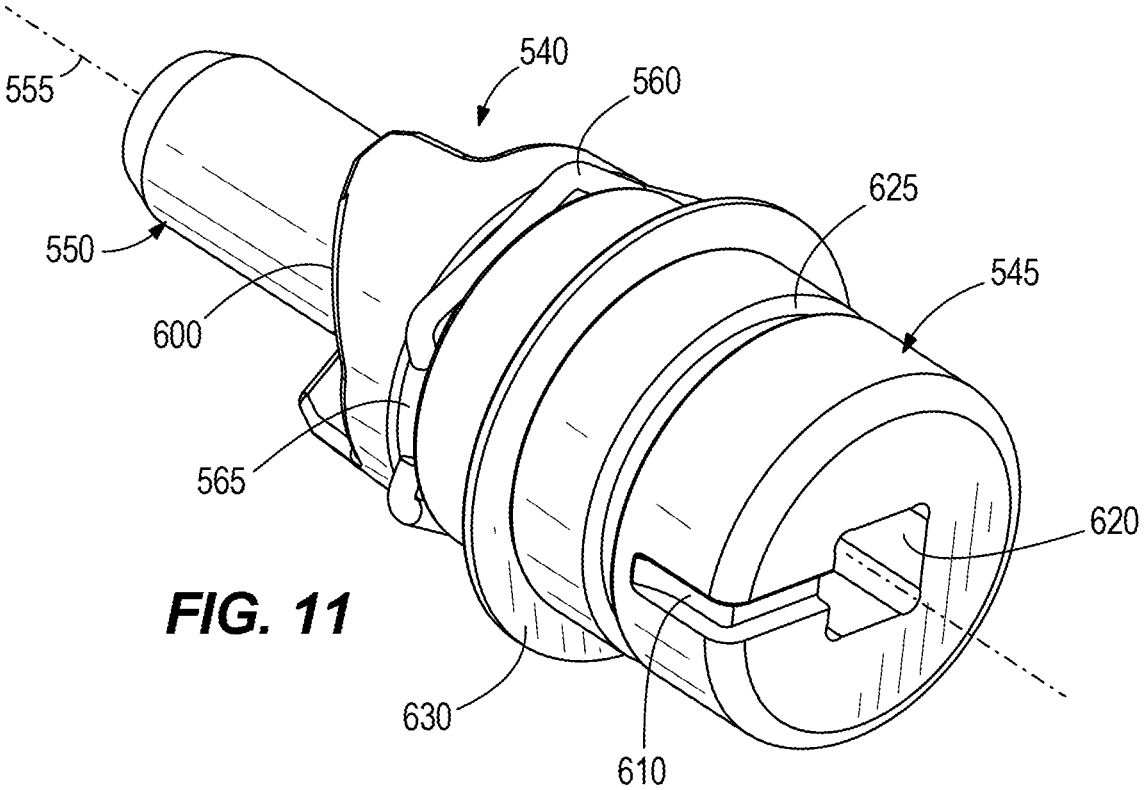
FIGS. 11 and 12 are perspective views of a pin of the locking system of FIG. 10.
Figure 12:
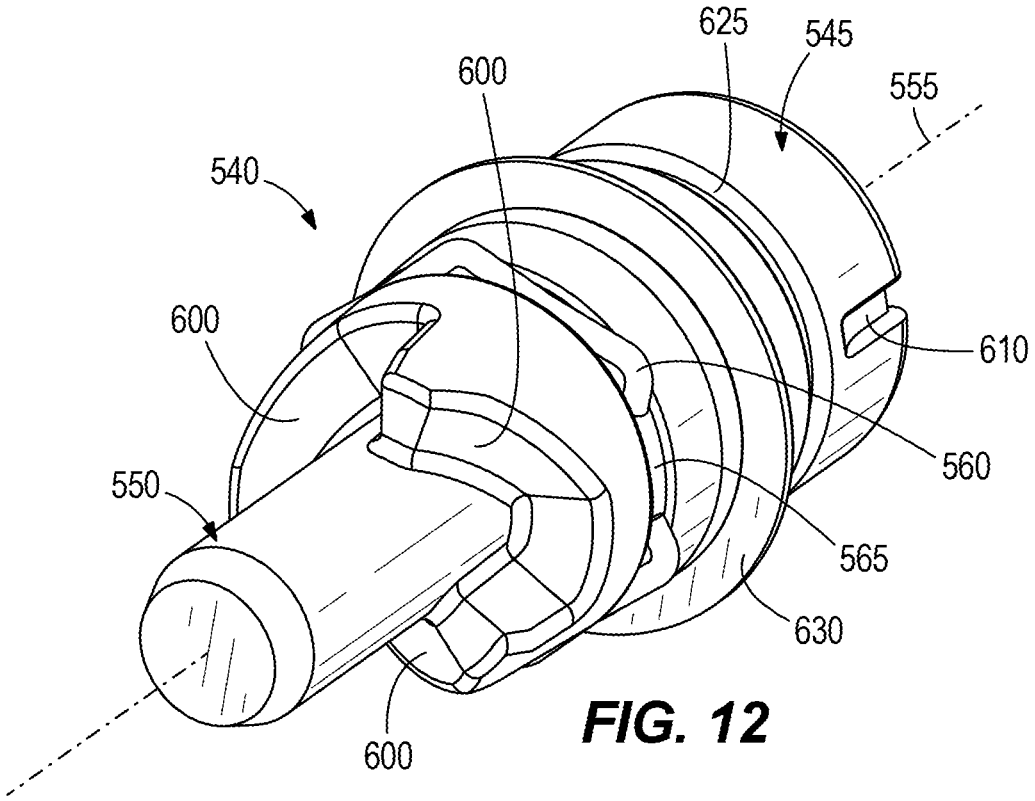

FIGS. 10-20 illustrate a tooth point locking system 535 according to another construction of the invention, which releasably couples a tooth point 530 to an adapter 525. The tooth point locking system 535 includes two pins 540, although only one is shown in FIG. 10 and further constructions could include a single pin 540. Each of the pins 540 includes a first, proximal head region 545 and a second, distal end region 550 that is spaced from the first, proximal head region 545 along an axis 555 (FIGS. 11 and 12). The first, proximal head region 545 is radially larger than the second, distal end region 550. In the illustrated construction, the second, distal end region 550 is a cylindrical post that extends from the first, proximal head region 545, although other constructions include a second, distal end region 550 having a varying diameter or otherwise having a different shape than that illustrated.

Figure 13:
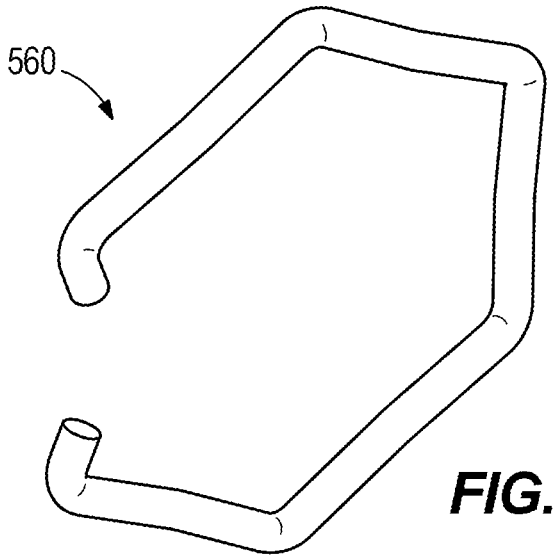
FIG. 13 is a perspective view of a spring clip of the locking system of FIG. 10.

Referring to FIGS. 11-13, the tooth point locking system 535 further includes biasing elements 560 that are coupled to the pins 540. In the illustrated construction, the biasing elements 560 are spring clips. As illustrated in FIG. 13, the spring clip biasing elements 560 are metallic, and have a generally hexagonal shape, although other constructions include different materials, sizes and/or shapes for the biasing elements 560 than that illustrated.

Referring to FIGS. 11 and 12, each of the pins 540 includes a groove 565 (e.g., a circumferential groove) located on the proximal head region 545. The biasing element 560 is shaped and sized to fit in one of the grooves 565, such that when the biasing element 560 is in a natural, uncompressed state (FIGS. 11 and 12), portions of the biasing element 560 are disposed within the groove 565 and other portions of the biasing element 560 extend radially outwardly away from the groove 565.

Figure 14:
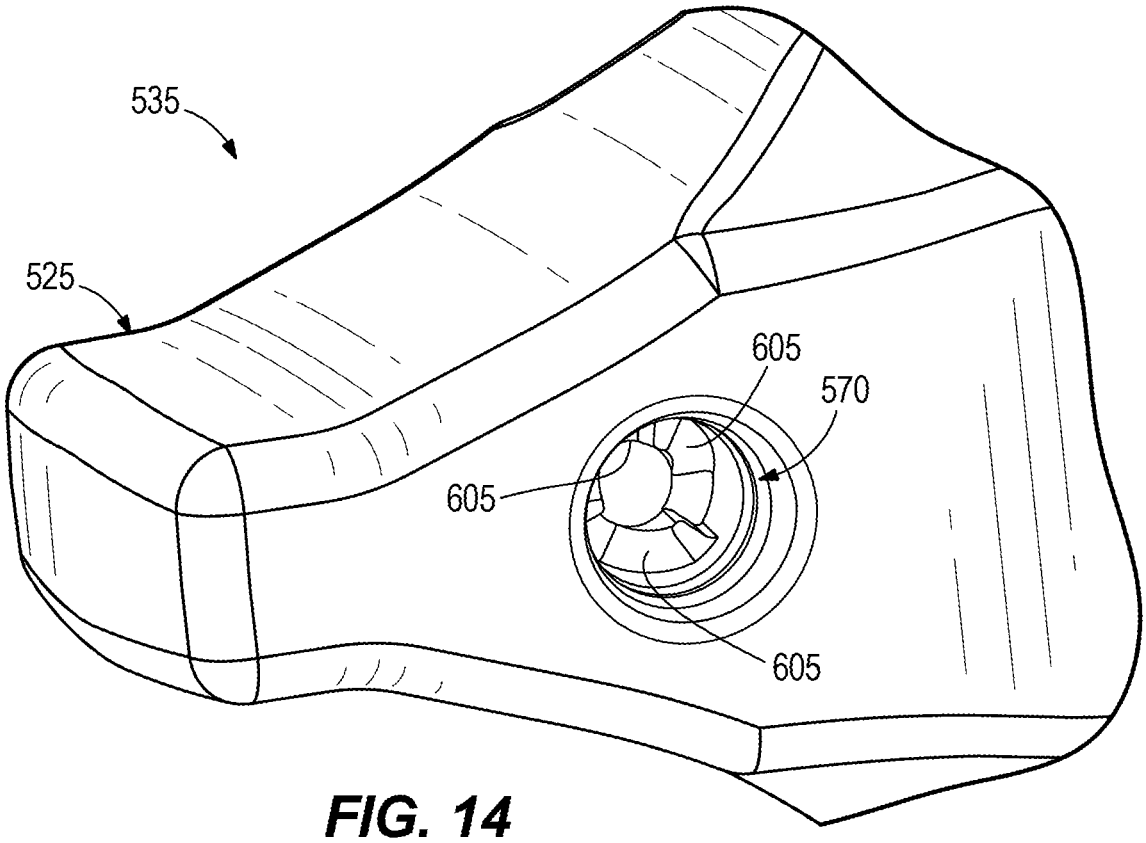
FIG. 14 is a perspective view of a portion of an adapter having ramped surfaces forming part of the locking system of FIG. 10.
Figure 15:
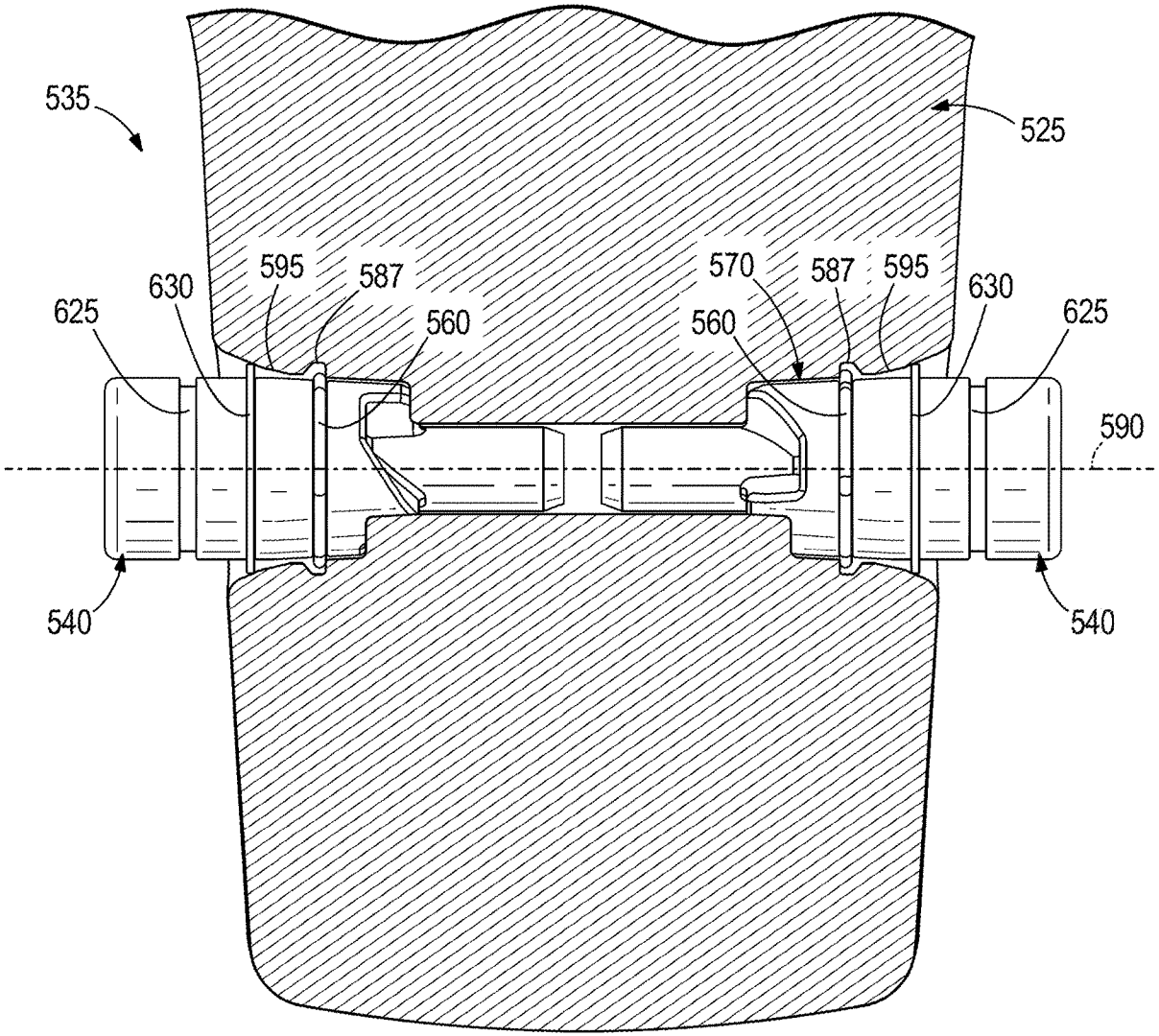
FIGS. 15-20 are cross-sectional and perspective views of the locking system of FIG. 10, illustrating positioning of the pins in the adapter.
Figure 16:
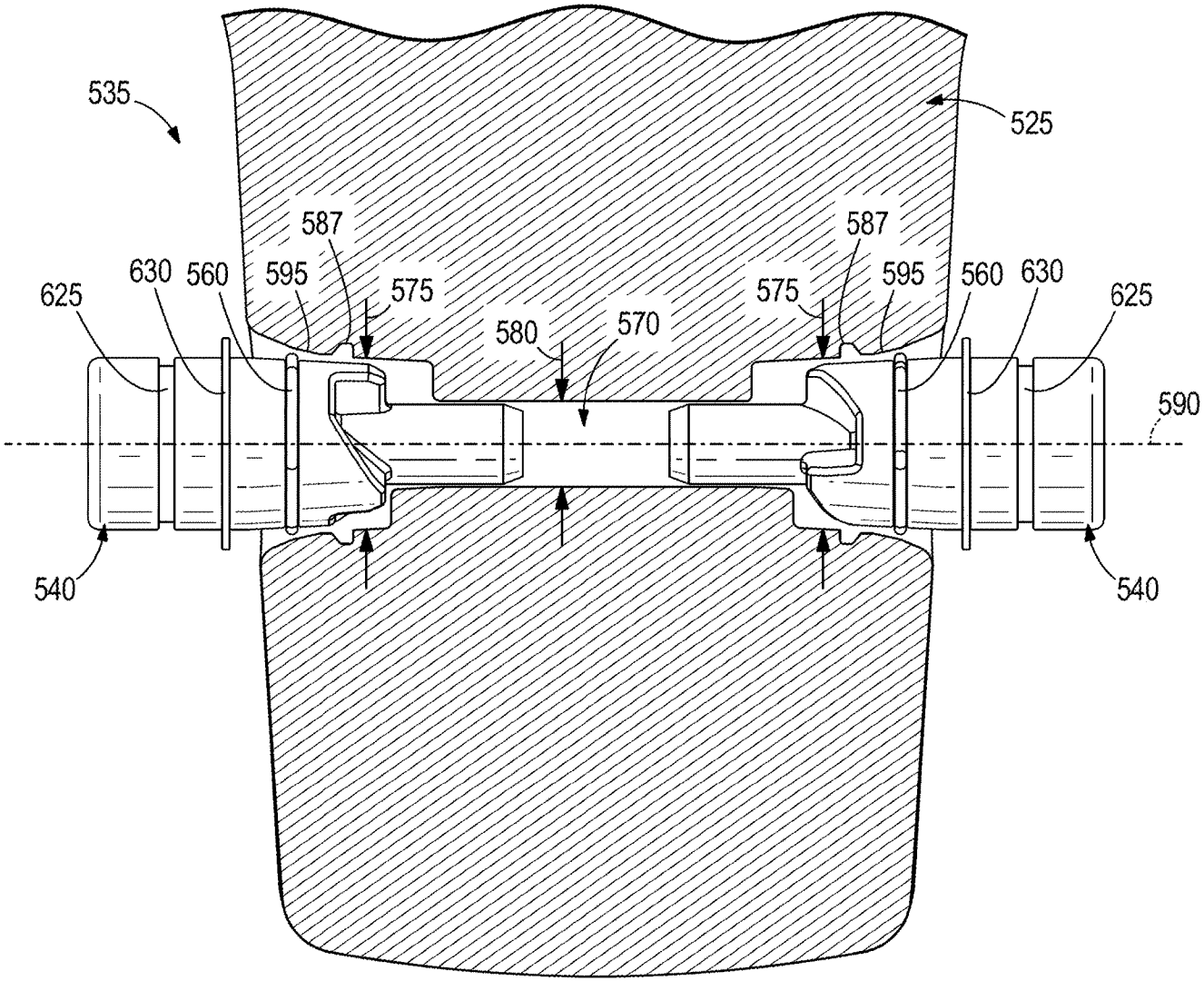

Referring to FIGS. 14-16, the tooth point locking system 535 further includes at least one interior passage 570 in the adapter 525 to receive the pins 540 and the biasing elements 560. In the illustrated construction, the tooth point locking system 535 includes a single interior passage 570 that extends entirely through the adapter 525. As illustrated in FIG. 16, the interior passage 570 includes a first diameter 575 where the second, distal end region 550 of each pin 540 initially enters the adapter 525, and a second diameter 580 that is disposed further within the adapter 525. The second diameter 580 is smaller than the first diameter 575. The tooth point locking system 535 additionally includes recesses 585 (FIGS. 17 and 18) in the tooth point 530 that are shaped and sized to receive the first, proximal head regions 545 of the pins 540.

Figure 17:
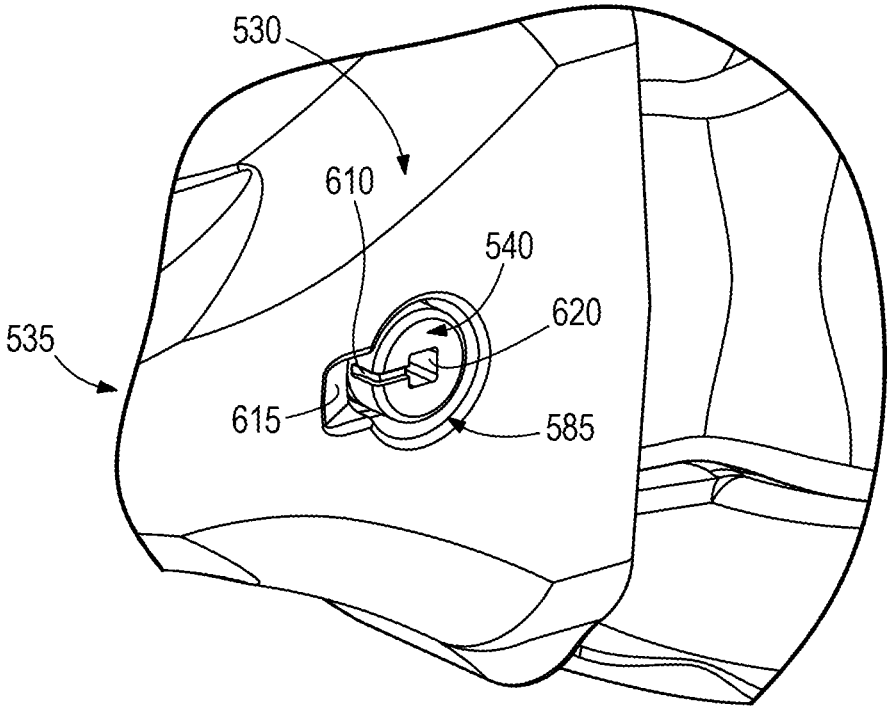

Referring to FIGS. 15 and 16, each of the pins 540 is inserted into the adapter 525 simply by pressing and/or pushing on the pins 540 axially, along an axis 590 (FIG. 15) that extends through the interior passage 570. When the pin 540 slides into the adapter 525, the biasing element 560 is radially compressed into the groove 565 on the pin 540 by an interior wall 595 of the adapter 525 that forms the interior passage 570. In the illustrated construction, the interior wall 595 narrows in width or diameter moving inwardly along the interior passage 570, although in other constructions the interior wall 595 has a constant width or diameter. The biasing element 560 compresses as it moves inwardly along the interior passage 570, thereby allowing the pin 540 and the biasing element 560 to slide together within the interior passage 570 until the biasing element 560 reaches an internal groove 587 in the adapter 525. When the biasing element 560 reaches the internal groove 587, the biasing element 560 expands radially into the internal groove 587, locking the pin 540 in place and inhibiting axial movement of the pin 540 back out of the adapter 525. As illustrated in FIGS. 15 and 17, in this locked position the first, proximal head region 545 is nested within the recess 585 on the tooth point 530.

Referring to FIGS. 11, 12, and 14, the pins 540 each include three helical ramped surfaces 600 (FIGS. 11 and 12) at a distal end of the proximal head region 545. The ramped surfaces 600 are spaced equidistantly around the pin 540. The adapter 525 includes corresponding helical ramped surfaces 605 (FIG. 14) within the interior passage 570. When the pins 540 are pressed into the interior passages 570, the helical ramped surfaces 600 of the pins 540 align with and press against the helical ramped surfaces 600 in the adapter 525. Thus, the helical ramped surfaces 600 of the pins 540 and the helical ramped surfaces 605 of the adapter 525 act as keyed surfaces that facilitate rotational alignment of the pins 540 within the interior passage 570. Other constructions include different numbers and arrangements of ramped (e.g., helical) surfaces, or other keyed surfaces or structures that facilitate a particular rotational alignment of the pins 540 relative to the interior passage 570.

Referring to FIGS. 11, 12, and 17, the pins 540 each include an external groove 610 (or other marking) along a radially exterior side of the proximal head region 545 that identifies when the pins 540 have been fully inserted into the interior passage 570 and when the ramped surfaces 600 of the pins 540 are in contact with the ramped surfaces 605 in the adapter 525. As illustrated in FIG. 17, the recess 585 of the tooth point 530 includes a notched region 615. When the pin 540 has been fully inserted into the interior passage 570 and the ramped surfaces 600, 605 are in contact, the groove 610 is visible through the notched region 615.

To remove the pins 540 from the adapter 525, the pins 540 are initially rotated about the axis 555. For example, in the illustrated construction, the pins 540 each include a tool engagement recess 620 along the first, proximal head regions 545. While the illustrated tool engagement recess 620 has a generally square shape, other constructions include different shapes. In some constructions, a tool engagement projection is instead used to receive a tool. In the illustrated construction, a tool (e.g., wrench or other hand tool) is inserted into the tool engagement recess 620, and is turned to cause the pin 540 to rotate about the axis 555. Rotation of the pin 540 about the axis 555 causes the helical ramped surfaces 600 of the pin 540 to ride along the helical ramped surfaces 605 of the adapter 525, thereby causing an axial displacement of the pin 540 along the axis 555 (FIGS. 15-18).

Referring to FIGS. 15 and 16, the axial displacement of the pin 540 along the axis 555 forces the biasing element 560 to be pulled out of the internal groove 587. This movement compresses the biasing element 560 back into the groove 565 on the pin 540, allowing the pin 540 and the biasing element 560 to slide along the interior passage 570 and out of the adapter 525.

Figure 18:
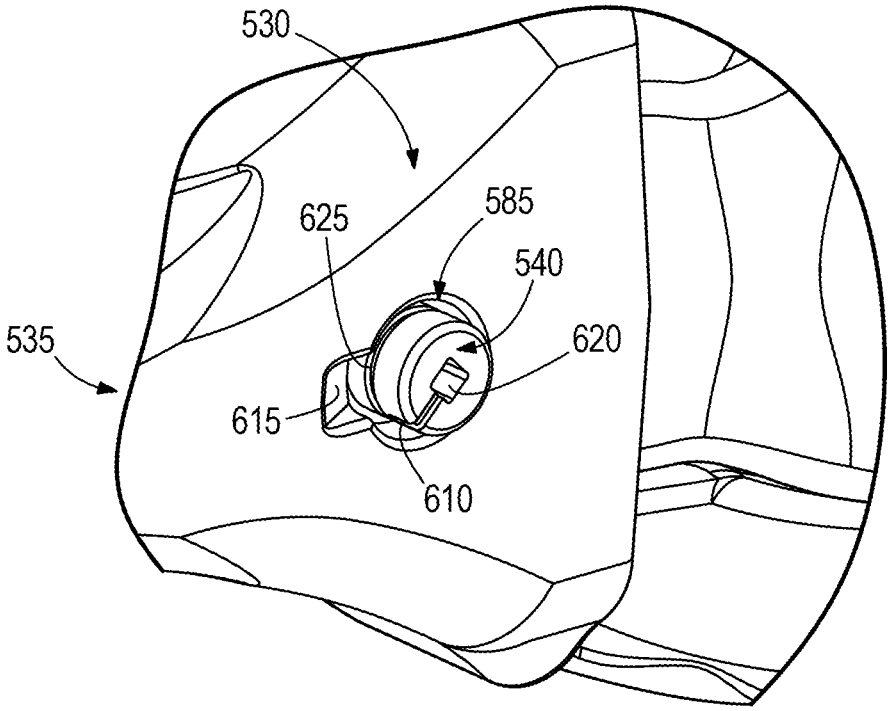
Figure 19:
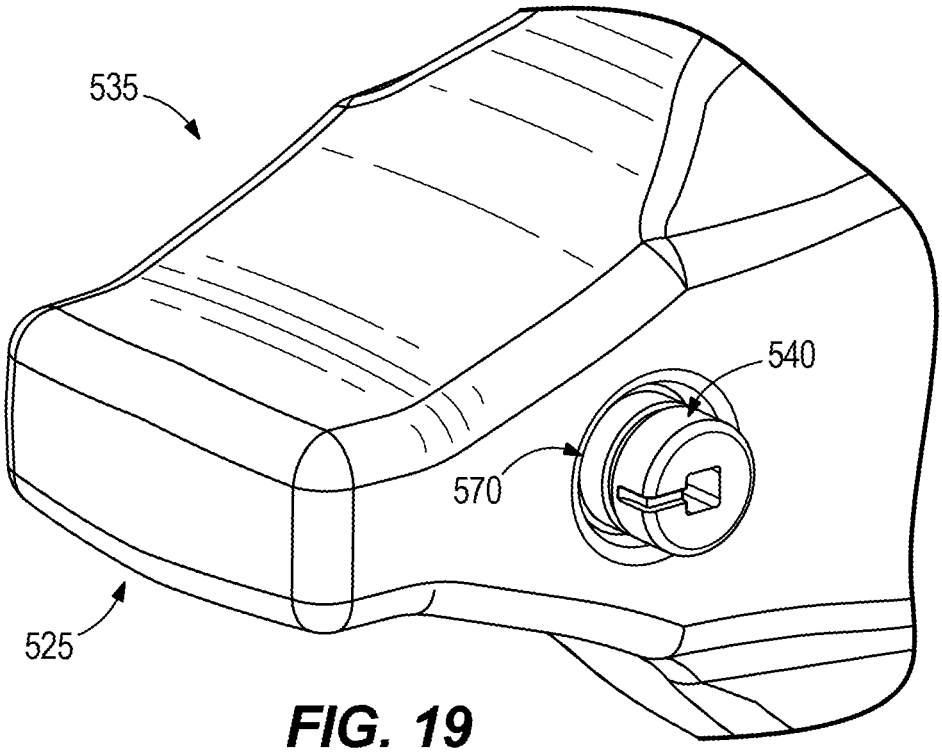
Figure 20:
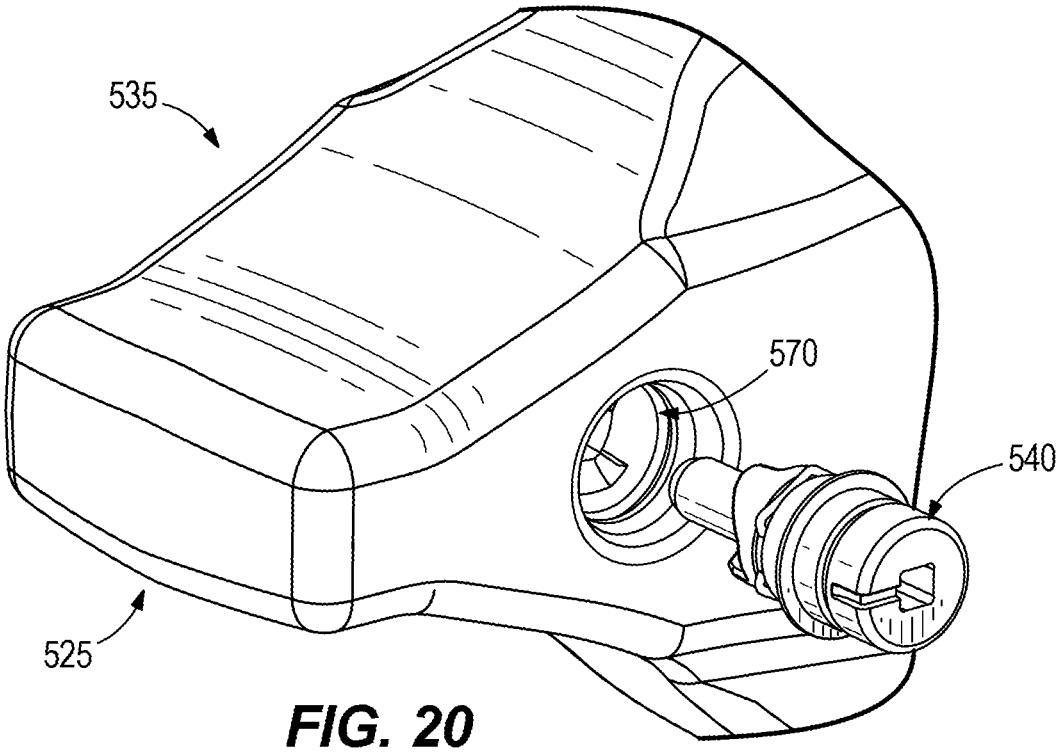

Referring to FIGS. 11, 12, and 18, in the illustrated construction, the notched region 615 (FIG. 18) is also a prying recess that provides access for another tool (e.g., pry bar) to be inserted to remove the pin 540 after the pin 540 has initially been rotated. As illustrated in FIGS. 11 and 12, the pins 540 each include a prying groove 625 sized and shaped to receive the pry tool. In the illustrated construction, the prying groove 625 is a circumferential groove. Other constructions include different shapes and sizes for the prying groove 625. As illustrated in FIG. 18, the prying groove 625 becomes visible and accessible only after the pin 540 has been rotated and initially axially displaced from the interior passage 570. Other constructions do not include a prying groove 625. For example, in some construction, once the pins 540 have been initially rotated and axially displaced (and the biasing elements 560 have been compressed), the pins 540 may be pulled out by hand, or with a different tool (e.g., eyelet) that grasps portions of the pins 540 and is used to pull the pins 540 fully out of the adapter 525.

Referring to FIGS. 11, 12, and 15, the locking system 535 further includes sealing elements 630 coupled to the pins 540. In the illustrated construction, the sealing elements 630 are rubber O-rings. Other constructions include different materials, shapes, or sizes than that illustrated. As illustrated in FIG. 15, the sealing elements 630 press against the interior wall 595 when the pins 540 are fully inserted into the adapter 525, thus inhibiting sand, dirt, etc. from entering the interior passage 570.

Although the invention has been described in detail referring to certain preferred embodiments, variations and modifications exist within the scope and spirit of one or more independent aspects of the invention as described.

What is claimed is:

1. A ground engaging tool locking system comprising:

a pin having a first, proximal head region and a second, distal end region spaced from the first, proximal head region along an axis, wherein the pin includes a groove located along an exterior surface of the pin, wherein the groove is configured to receive a biasing element; and an adapter having an interior passage extending along an axis, wherein the interior passage is configured to receive the pin and the biasing element, wherein at least a portion of the interior passage tapers and narrows in width moving inwardly along the interior passage, such that the interior passage includes a first diameter adjacent an outer surface of the adapter, and a second, smaller diameter axially inwardly of the outer surface;

wherein the adapter includes a protrusion along a side of the adapter, and wherein the first, proximal head region includes a region that is sized and shaped and configured to fit over the protrusion.

2. The ground engaging tool locking system of claim 1, wherein the interior passage includes an internal groove.

3. The ground engaging tool locking system of claim 2, wherein the internal groove is disposed axially inwardly of the portion of the interior passage that narrows in width.

4. The ground engaging tool locking system of claim 3, wherein the interior passage includes a further portion that has a generally constant diameter, wherein the further portion is disposed axially inwardly of the internal groove.

5. The ground engaging tool locking system of claim 2, further comprising the biasing element, wherein the biasing element is disposed partially in the groove of the pin and partially within the internal groove.

6. The ground engaging tool locking system of claim 1, wherein the protrusion is a wedge having an inclined surface.

7. The ground engaging tool locking system of claim 6, wherein when the pin is rotated about the axis, the proximal head region is configured to ride along the inclined surface, so as to axially displace the pin along the axis.

8. A ground engaging tool locking system comprising:

a pin having a first, proximal head region and a second, distal end region spaced from the first, proximal head region along an axis, wherein the pin includes a groove located along an exterior surface of the pin, wherein the pin is configured to receive a biasing element;

an adapter having an interior passage extending along an axis, wherein the interior passage is configured to receive the pin and the biasing element, wherein the interior passage includes a first portion having a first diameter, a second portion having a second diameter, and a third portion having a third diameter, wherein the adapter includes a first interior wall that forms a transition between first portion and the second portion, and a second interior wall that forms a transition between the second portion and the third portion, wherein the second portion is disposed axially between the first portion and the third portion, and wherein the second diameter is larger than both the first diameter and the third diameter; and the biasing element, wherein the biasing element is disposed partially in the groove of the pin and is pressed against the first interior wall of the adapter.

9. The ground engaging tool locking system of claim 8, wherein the pin includes a separate internal passage extending through the pin, wherein the separate internal passage is threaded.

10. The ground engaging tool locking system of claim 8, wherein the adapter includes an inclined surface, wherein when the pin is rotated about the axis, the inclined surface is configured to axially displace the pin.

11. A ground engaging tool locking system comprising:

a pin having a first, proximal head region and a second, distal end region spaced from the first, proximal head region along an axis, wherein the pin includes a groove located along an exterior surface of the pin, wherein the pin is configured to receive a biasing element;

an adapter having an interior passage extending along an axis, wherein the interior passage is configured to receive the pin and the biasing element, wherein the interior passage includes a first portion having a first diameter, a second portion having a second diameter, and an interior wall that forms a transition between first portion and the second portion, wherein the biasing element is configured to expand radially and press against the interior wall to lock the pin in place once the pin has been pressed axially into the interior passage, wherein the adapter includes an inclined surface, and wherein when the pin is rotated about the axis, the inclined surface is configured to axially displace the pin.

12. The ground engaging tool locking system of claim 11, wherein the pin includes a separate internal passage extending through the pin, wherein the separate internal passage is threaded.

13. The ground engaging tool locking system of claim 11, further comprising the biasing element, wherein the biasing element is disposed partially in the groove of the pin and is pressed against the interior wall of the adapter.

14. A ground engaging tool locking system comprising:

a pin having a first, proximal head region and a second, distal end region spaced from the first, proximal head region along an axis, wherein the pin includes a groove located along an exterior surface of the pin, wherein the pin is configured to receive a biasing element;

an adapter having an interior passage extending along an axis, wherein the interior passage is configured to receive the pin and the biasing element, wherein the interior passage includes a first portion having a first diameter, a second portion having a second diameter, and a third portion having a third diameter, wherein the adapter includes a first interior wall that forms a transition between first portion and the second portion, and a second interior wall that forms a transition between the second portion and the third portion, wherein the second portion is disposed axially between the first portion and the third portion, and wherein the second diameter is larger than both the first diameter and the third diameter;

wherein the adapter includes an inclined surface, wherein when the pin is rotated about the axis, the inclined surface is configured to axially displace the pin.

* * * * *